US005499219A

United States Patent [19]

Brenner et al.

[11] Patent Number: 5,499,219

[45] Date of Patent: Mar. 12, 1996

[54] ELECTRO-ACOUSTICAL TRANSDUCER ARRANGEMENT

[75] Inventors: Axel Brenner; Peter Mertens; Wilfried Meuser; Friedrich Meyer, all of Bremen; Horst Trense, Oyten; Friedrich Weber, Zeven-Badenstedt; Wilfried Wilken, Bad Zwischenahn, all of Germany

[73] Assignee: STN Atlas Elektronik GmbH, Bremen, Germany

[21] Appl. No.: 341,868

[22] Filed: Nov. 15, 1994

[30] Foreign Application Priority Data

Nov. 23, 1993 [DE] Germany ..... 43 39 798.0

[51] Int. Cl.[6] ..... H04R 17/00

[52] U.S. Cl. ..... 367/151; 367/154; 367/155; 310/337

[58] Field of Search ..... 367/154, 153, 367/155, 151; 310/337

[56] References Cited

FOREIGN PATENT DOCUMENTS 596429 3/1990 Australia .

*Primary Examiner*—Charles T. Jordan
*Assistant Examiner*—Christopher K. Montgomery
*Attorney, Agent, or Firm*—Spencer & Frank

[57] ABSTRACT

An electro-acoustical transducer arrangement for underwater antennas comprised of a plurality of hydrophones (10) which are arranged at equal distances in a linear array, and are to be disposed vertically above each other on a support. For reasons of a simplified assembly along with good receiving properties, the hydrophones (10), together with a reflector (11) disposed behind them in the direction of incoming sound, are embedded in an acoustically transparent rigid cast enclosure (20) of an elastomer, preferably polyurethane, which can be worked in a casting process. The connecting lines (12) of the hydrophones (10) of the enclosure 20 are combined in a common plug (13), which is accessible on a front end of the rigid cast enclosure (20). The rigid cast enclosure (20) is provided with devices for fastening the enclosure to the support.

20 Claims, 3 Drawing Sheets

ELECTRO-ACOUSTICAL TRANSDUCER ARRANGEMENT

REFERENCE TO RELATED APPLICATIONS

This application claims the priority of German application Ser. No. P 43 39 798.0 filed Nov. 23, 1993, which is incorporated herein by reference.

BACKGROUND OF THE INVENTION

The invention relates to an electro-acoustical transducer arrangement for underwater antennas and which is comprised of a plurality of hydrophones which are to be arranged at equal distances in a linear array (vertically above each other) on a support, and which are provided with connecting lines for their electrical connection.

Such electro-acoustical transducer arrangements, generally referred to as staves, are fastened on cylinder-shaped or horseshoe-shaped supports for the purpose of passive acoustical locating in the frequency range between 1 and 12 kHz and as a whole form a receiving antenna or receiver base on the support which, depending on the structural type, is called a cylinder base or cylindrical hydrophone array (CHA) or horseshoe base or conformal array. Cylinder bases permit locating over a panoramic angle of 360°, while horseshoe bases, wherein the support is preferably formed by the ship's bow itself, permit locating over a somewhat restricted sector.

In known cylinder bases the hydrophones of the transducer arrangements or staves are individually fastened on a cylinder steel support via decoupling elements used for decoupling structure-borne sound, and their connecting lines in the form of insulated cables are individually connected with the receiver device. In this case the connecting cable of, for example, 96 staves of a cylinder base are combined in a cable harness and brought to the receiver unit through a water-pressure-resistant duct. Panels of polyurethane (PUR) foam are additionally attached on the steel support to improve the front-to-back ratio of the transducer arrangement. Receiver bases put together from such transducer arrangements have a heavy dead weight, great natural resonance and require a very large amount of time for their assembly.

SUMMARY OF THE INVENTION

It is therefore the object of the invention to provide a transducer arrangement of the type mentioned at the outset which has a good front-to-back ratio and by means of which the assembly time for producing an underwater antenna with at least unchanged good acoustical locating properties is drastically reduced.

In accordance with the invention, this object generally is attained by an electro-acoustical transducer arrangement for attachment to a support for an underwater antennas which comprises: a plurality of hydrophones which are arranged at equal distances in a linear array and which are provided with respective connecting lines for their electrical connection; a reflector disposed behind the linear array of hydrophones in the direction of incoming sound; an acoustically transparent rigid cast enclosure formed of an elastomer which can be worked in a casting process, with the hydrophones and the reflector being embedded in the rigid enclosure; a common plug in which the connecting lines of the hydrophones of the transducer are combined, with the plug being accessible at a frontal end of the rigid cast enclosure; and means, provided on the rigid cast enclosure, for fastening the rigid cast enclosure on the support.

Thus, in the transducer arrangement according to the invention, all acoustically sensitive elements, i.e. the hydrophones and the reflector, of a stave are integrated in a compact structural unit wherein the position of the reflector and the hydrophones, which is set at exact tolerances as is necessary for a good front-to-back ratio, is reproducibly assured. The complete unit can be fastened on the support with a few manipulations wherein, because of the combination of the connecting lines of the hydrophones in one radially symmetrical plug, it is only necessary to provide a single electrical connection. This, as well as the fact that the exact position of the reflector and the hydrophones is set at exact tolerances and need not be taken into consideration during assembly, considerably reduces the assembly time per transducer arrangement or stave. All hydrophones are insulated against the aggressive ocean water by the surrounding rigid cast enclosure, preferably made of polyurethane, and there is only one place, namely the place where the plug is led out of the rigid cast enclosure, where it is necessary to take separate steps for preventing the water from penetrating. This simplifies the manufacture while at the same time increasing the percentage of the service life.

In connection with the cylinder base, the complete dimensionally-stable structural unit also opens the possibility of mounting the staves on a cylindrical support of fiberglass-reinforced plastic (GFK), by means of which it is possible to obtain a pronounced reduction in the weight of the underwater antenna.

Practical embodiments of the transducer arrangement in accordance with the invention are described and defined below.

In accordance with a preferred embodiment of the invention, the reflector has a sound-absorbent panel extending over all hydrophones which, in a further embodiment, constitutes the sound-absorbing spring of a spring-mass system. The mass portion is formed by a metal plate which rests against the front of the sound-absorbent panel facing the hydrophones. The mass of the metal plate and the sound absorbency of the panel, preferably made of polyurethane, are attuned to each other in such a way that above a predetermined resonance frequency usable sound arriving from the front is reflected onto the hydrophones and interfering sound coming from behind is screened out. The distance of the hydrophones from the metal plate of the spring-mass system is selected to be so small that no disturbing interferences between the directly incident sound and the usable sound reflected onto the hydrophones by the reflector occur over the entire frequency range relevant for the underwater antenna. A very high front-to-back ratio of the transducer arrangement is achieved by this construction and in this way bearing errors are prevented. With the frequency range predetermined for the effectiveness of the spring-mass system, the sound absorbency of the spring and the weight of the mass portion is optimized such that with predetermined water pressures, which are a function of the diving depth of the transducer arrangement, the properties of the spring element remain intact to a large extent. In addition, the depth-dependent requirements are brought into agreement with the maximally permissible total weight of the underwater antenna.

According to an advantageous feature of the invention, the metal plate is produced in a sandwich construction of two sheet metal plates with an interposed flexural wave damping layer, wherein the flexural wave damping layer preferably is a foil which is glued together with the two sheet metal plates. Such a flexural wave damping layer is described in German Patent Publication DE 36 21 318 A1, which corresponds to Australian Pat. No. 596429 for example. Interfering natural resonances of the mass of the reflector, which can be excited by coupling in of structure-borne sound or the underwater sound signals, are very well repressed by this sandwich construction of the metal plate.

In accordance with a further advantageous feature of the invention, small spherical ceramic bodies are used as hydrophones which, for maintaining a distance of exact tolerance from the reflector are fastened, preferably glued, on a spacer of plastic, which is maintained in an exact position on the reflector, prior to being embedded in the essentially viscoplastic elastomer. In this case the plastic spacer is preferably made of the same material with the same acoustical properties as the rigid cast enclosure. In this way it is assured that the distance of the hydrophones from the reflector is maintained at exact tolerances and reproducible in each transducer arrangement.

In a still further advantageous feature of the invention the plug, which is accessible from an end of the rigid cast enclosure, is integrated into a blind bore cut into the end surface of the rigid cast enclosure, which receives the matching plug which cooperates with the plug. To provide a pressure-sealed electric connection, the plug and the matching plug are embodied as coaxial plugs which are plugged together via several seal rings in a waterproof manner. Such coaxial plugs are known from German Patent Publication DE 37 14 553 A1. At least one radial bore cut from the exterior of the rigid cast enclosure terminates in the bottom of the blind bore, through which remaining water, which had entered the blind bore during the removal of the transducer arrangement from the water, can run off and in this way does not come into contact with the electrical plug contacts when the plug connection is opened and closed.

In accordance with another advantageous feature of the invention, the rigid cast enclosure has the shape of a rod with a rectangular or square cross section, and the connector plug for the hydrophones extends into the blind bore formed in a frontal end or end surface of the rigid cast enclosure. Bores are provided which completely penetrate the rigid cast enclosure and the reflector for fastening the rods. The transducer arrangements are fastened on the support by means of cap screws inserted through the bores.

The invention will be described in more detail below by means of an exemplary embodiment shown in the drawings.

DETAILED DESCRIPTION OF THE PREFERRED EMBODIMENT

Figure 1:
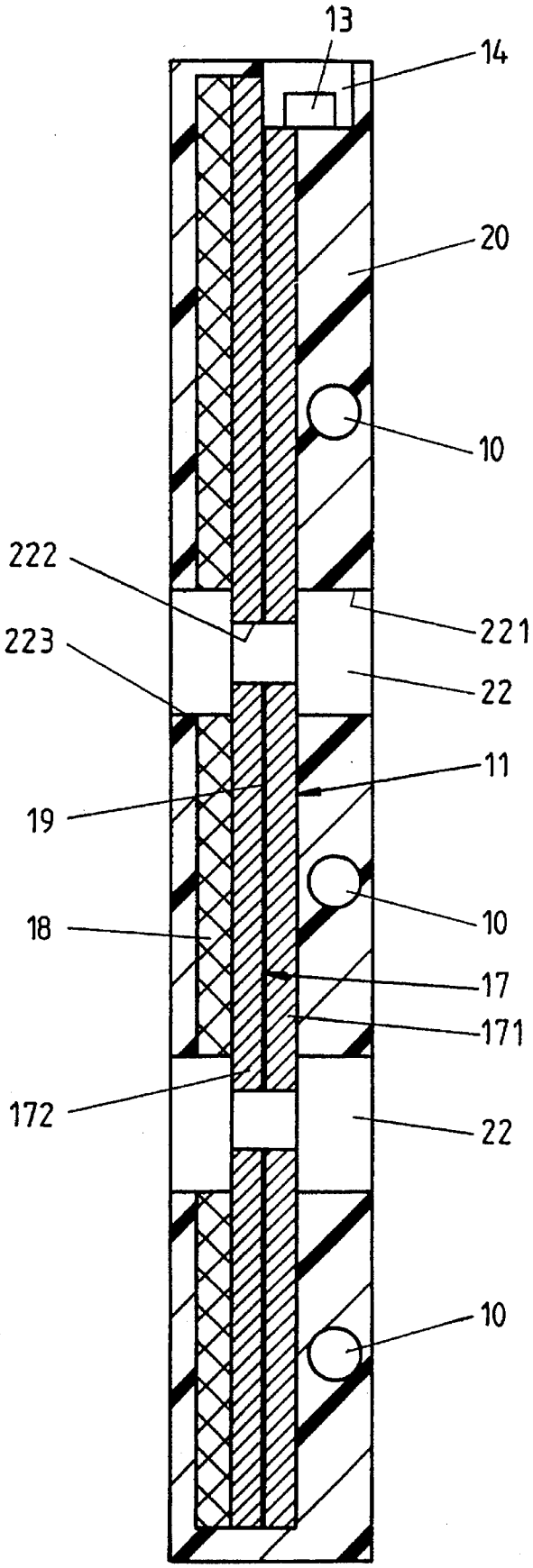
FIG. 1 is a schematic longitudinal section of a transducer arrangement for an underwater antenna according to the invention.

The electro-acoustical transducer arrangement for an underwater antenna shown schematically in longitudinal section in FIG. 1 has a total of three equally spaced linearly aligned hydrophones 10 which, together with a reflector 11 disposed behind the hydrophones in the direction of incoming sound, are embedded in an acoustically transparent rigid cast enclosure 20 of an essentially viscoplastic elastomer which can be worked in a casting process. In this case polyurethane (PUR) is used as the elastomer. The hydrophones 10 are small spherical ceramic bodies which can be seen in FIG. 2, and are provided with connecting lines 12 for making electrical connections. The connecting lines 12 of all three hydrophones 10 are combined in a common plug 13 which extends into a blind bore 14 formed in one front end of the cast enclosure 20. The matching plug cooperating with the plug 13 is identified by 15 and is received in the blind bore 14 when placed on the plug 13. The connecting cable 16 leading away from the matching plug 16 is used for connecting the three hydrophones 10, which here are switched in parallel, with a receiver device, not shown here. The plug 13 and the matching plug 15 are embodied as coaxial plugs.

The reflector 11 is embodied in the form of a spring-mass system formed by a mass portion and a sound-absorbent spring portion. In this system, the mass portion is provided by a metal plate 17 and the spring portion by a sound-absorbent plate, in this case an elastic non-rigid material panel 18, which rests on the back or major surface of the metal plate 17 facing away from the hydrophones 10. A panel of polyurethane foam is preferably used as the non-rigid material panel 18, the metal plate 17 preferably is made of aluminum. For suppressing interfering natural resonances, the metal plate 17 preferably is made as a sandwich construction and comprises two sheet metal plates 171 and 172 with an interposed flexural wave damping layer 19. Such a damping layer is described in German Patent Publication DE 36 21 318 A1 and can be used here. The layer 19 is preferably embodied as a foil and is glued to each of the two sheet metal plates 171, 172.

Figure 2:
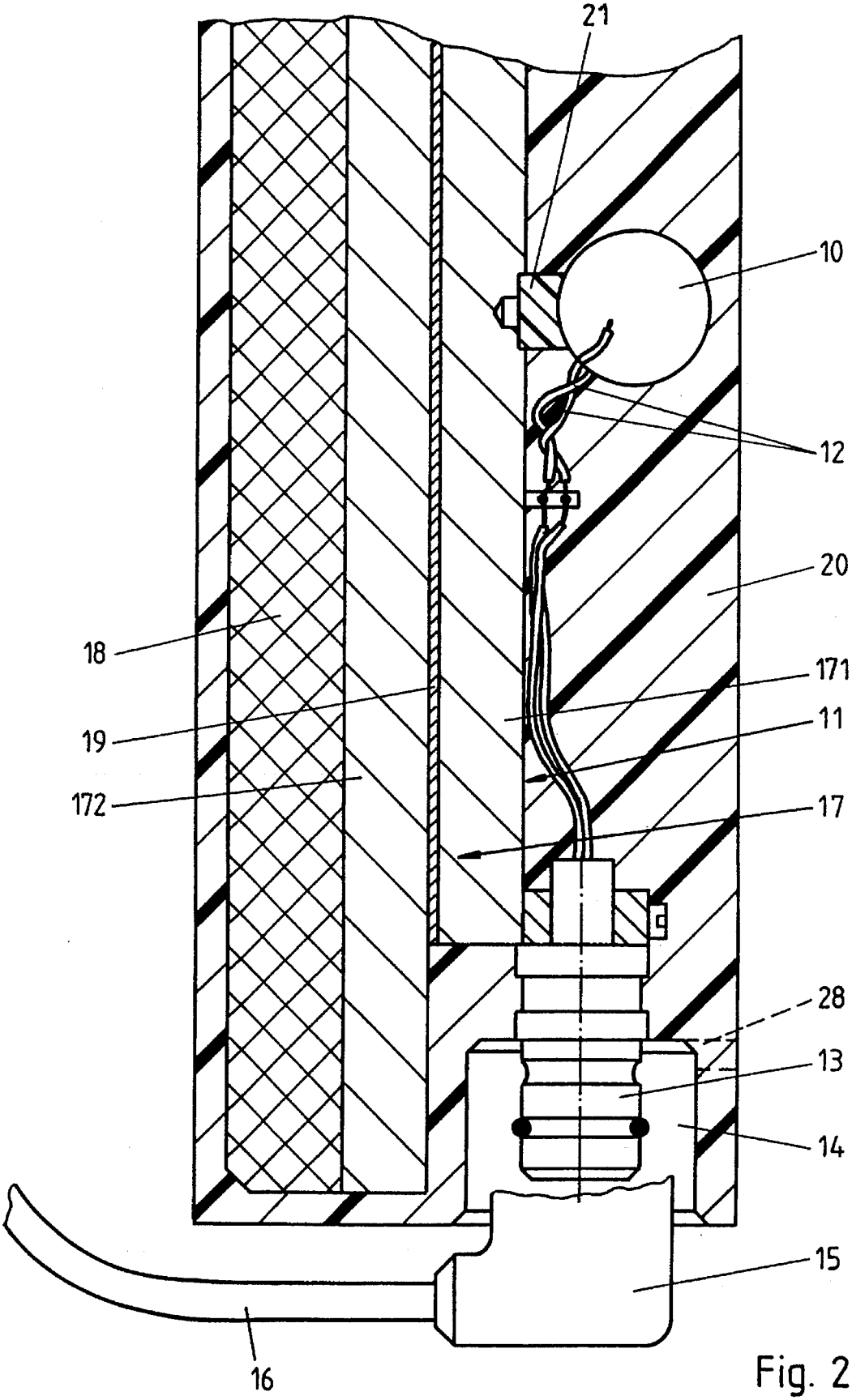
FIG. 2 shows a portion of a longitudinal section of the transducer arrangement of FIG. 1 in a structural embodiment.

To produce the rigid cast enclosure 20 of castable polyurethane, the reflector 11 and the plug 13 are inserted into an appropriate casting mold. To maintain a distance of exact tolerances from the reflector 11, the hydrophones 10 are each glued to a respective spacer 21 (FIG. 2). The spacers 21 are fixed or mounted in exact positions on the reflector 11, namely on its metal plates 17, for example, by means of shallow depressions in the metal plate 17 or by gluing. Preferably the spacers 21 are made of the same material as the rigid cast enclosure 20, i.e., of polyurethane. After pouring the polyurethane into the mold and after its curing, the complete transducer arrangement can be taken out of the mold. In this case the rigid cast enclosure 20 is given a rod shape with a rectangular or square cross section, on one front end of which the blind bore 14 is formed, and the plug 13 extends from the bottom of the blind bore 14, so that a plug axis extends in a direction of the linear array. To assure the run-off of water out of the blind bore 14, at least one and preferably two diametric radial bores 28, have been cut in the rigid cast enclosure 20 so that they terminate in the bottom of the blind bore 14, which are represented in FIG. 2 turned by 90° into the drawing plane.

Two bores 22 (FIG. 1) are provided for fastening the rod-shaped transducer arrangement on a support and are arranged symmetrically between the hydrophones 10 and completely penetrate through the rigid cast enclosure 20 and the reflector 11. In this case, the bore section 222 penetrating through the metal plate 17 of the reflector 11 has a considerably smaller diameter than the bore sections 221 and 223, which extend from the front of the rigid cast enclosure 20 facing away from the support as far as the non-rigid material plate 18 and through it. The bores 22 each receive cap screws by means of which the rod-shaped transducer arrangement is fastened on the support. The head of the cap screws in this case rests directly or via spacers which decouple structure-borne sound, made of polyurethane, on the metal plate 17. The direct contact is preferred for reasons of cost in an underwater antenna in accordance with FIG. 3, wherein the transducer arrangements are screwed on a fiberglass-reinforced plastic (GFK) cylinder 23 as the support. The spacers which decouple structure-borne sound must be employed when the rod-shaped transducer arrangements are directly fastened to a ship's bow to form a conformal array.

Figure 3:
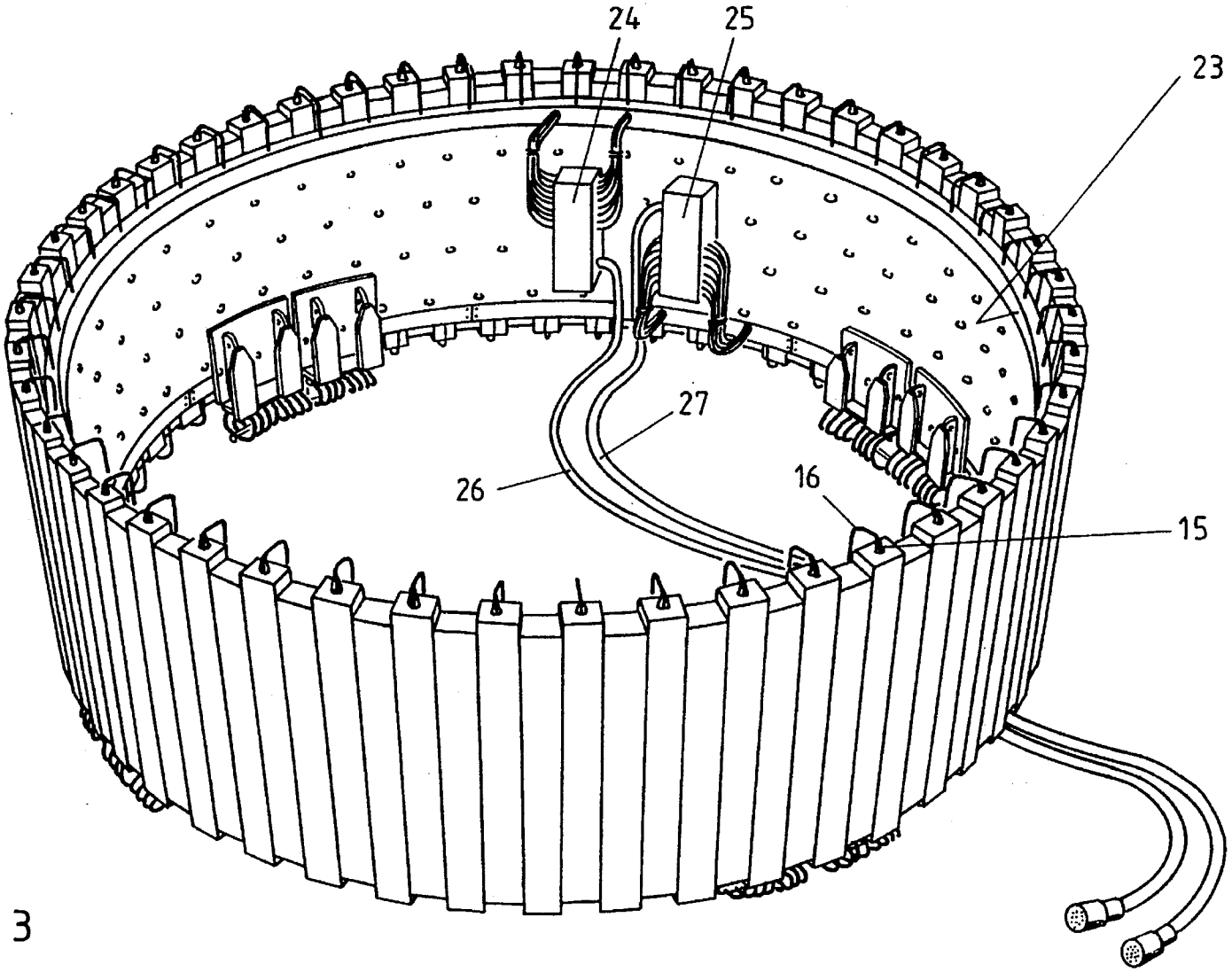
FIG. 3 is a perspective view of a cylinder base constructed with transducer arrangements in accordance with FIG. 2.

The underwater antenna shown in a perspective view in FIG. 3, has been put together from a plurality of electro-acoustical transducer arrangements, so-called staves, according to the invention such as previously described. The underwater antenna conceptualized as a receiver base is embodied as a cylinder base, wherein the individual staves are placed on the exterior of a cylinder-shaped support made of fiberglass-reinforced plastic (GFK) and are fixedly connected with the support 23 via screws (not shown) exiting through their bores 22. The individual rod-shaped staves have been alternatingly turned by 180° in respect to each other, so that the plugs 13 of neighboring staves are located one time on the upper end and the next time on the lower edge of the support 23 as can be seen in FIG. 3. One half of the connecting cables 16 of a total of 96 staves are led respectively along the upper and along the lower edge of the cylinder-shaped support 23 and are brought together in a respective connecting unit 24 or 25. A multiple cable 26 and 27 leads from each connecting unit 24 or 25 to the receiver device, not shown here.

The invention now being fully described, it will be apparent to one of ordinary skill in the art that any changes and modifications can be made thereto without departing from the spirit or scope of the invention as set forth herein.

What is claimed:

1. An electro-acoustical transducer arrangement for attachment to a support for an underwater antenna comprising:

a plurality of hydrophones arranged at equal distances in a linear array and provided with respective connecting lines for their electrical connection;

a reflector disposed behind said linear array of hydrophones in the direction of incoming sound;

a sole, acoustically transparent rigid cast enclosure formed of an elastomer which can be worked in a casting process, with said hydrophones and said reflector being entirely embedded to completely enclose said hydrophones and said reflector in said rigid cast enclosure;

a common plug in which said connecting lines of said hydrophones of said transducer arrangement are combined, with said plug having a plug axis extending in a direction of the linear array, said plug being accessible at a frontal end of said rigid cast enclosure; and means for fastening said rigid cast enclosure on the support, said means being provided in said rigid cast enclosure.

2. A transducer arrangement as defined in claim 1, wherein said rigid cast enclosure is made of polyurethane.

3. A transducer arrangement as defined in claim 1, wherein said reflector includes a sound-absorbing panel mounted to said reflector and extending behind all of said hydrophones.

4. A transducer arrangement as defined in claim 3, wherein said sound-absorbing panel is made of polyurethane foam.

5. A transducer arrangement as defined in claim 3, wherein said reflector is a spring-mass system with said sound-absorbing panel constituting a sound-absorbent spring of the spring-mass system, and with a mass portion of the spring-mass system being constituted by a metal plate, which rests against a front surface of said sound-absorbing panel facing said hydrophones.

6. A transducer arrangement as defined in claim 5, wherein the mass of the metal plate and the sound absorbency of said sound-absorbing panel are attuned to each other such that usable sound arriving from the front, and above a predetermined resonance frequency, is reflected onto said hydrophones, and interfering sound coming from behind is screened out.

7. A transducer arrangement as defined in claim 6, wherein said metal plate is made in a sandwich construction of two sheet metal plates with an interposed flexural wave damping layer.

8. A transducer arrangement as defined in claim 7, wherein said flexural wave damping layer is a foil which is glued to said two sheet metal plates.

9. A transducer arrangement as defined in claim 5, wherein said metal plate is made in a sandwich construction of two sheet metal plates with an interposed flexural wave damping layer.

10. A transducer arrangement as defined in claim 9, wherein said flexural wave damping layer is a foil which is glued to said two sheet metal plates.

11. A transducer arrangement as defined in claim 9, wherein said sheet metal plates are made of aluminum.

12. A transducer arrangement as defined in claim 5, wherein said metal plate is made of aluminum.

13. A transducer arrangement as defined in claim 1, wherein: said hydrophones are spherical ceramic bodies; and each of said hydrophones is fastened on a respective spacer which is fixedly mounted in an exact position on said reflector to maintain each said hydrophone at a distance of exact tolerance from said reflector.

14. A transducer arrangement as defined in claim 1, wherein: said plug extends into a blind bore, which is formed in an end surface of said rigid cast enclosure at said frontal end, for receiving a matching plug cooperating with said plug; and at least one radial bore extends from the outside of said rigid cast enclosure and terminates in the bottom of said blind bore.

15. A transducer arrangement as defined in claim 1, wherein said rigid cast enclosure has the shape of a rod with one of a rectangular and a square cross section.

16. A transducer arrangement as defined in claim 1, wherein said fastening means comprise bores extending through said rigid cast enclosure and said reflector.

17. A transducer arrangement as defined in claim 16, wherein: said reflector is a spring-mass system with a sound-absorbing panel constituting a sound-absorbent spring of the spring-mass system, and with a mass portion of the spring-mass system being constituted by a metal plate which rests against a front surface of said sound-absorbing panel facing said hydrophones; and said bores have a first bore section which extends from a front surface of said rigid cast enclosure facing said hydrophones to said metal plate of said reflector and a second bore section passing through said metal plate, with said first bore section having a considerably greater diameter than said second bore section.

18. A transducer arrangement as defined in claim 1 further comprising a cylindrical support of fiberglass-reinforced plastic to which said transducer arrangement is attached such that said linear array extends in the axial direction of said support.

19. An underwater antenna comprising a plurality of transducer arrangements and a cylindrical support of fiberglass-reinforced plastic, each said transducer arrangement comprising:

a plurality of hydrophones arranged at equal distances in a linear array and provided with respective connecting lines for their electrical connection;

a reflector disposed behind said linear array of hydrophones in the direction of incoming sound;

a sole, acoustically transparent rigid cast enclosure formed of an elastomer which can be worked in a casting process, with said hydrophones and said reflector being entirely embedded to completely enclose said hydrophones and said reflector in said rigid cast enclosure;

a common plug in which said connecting lines of said hydrophones of said transducer arrangement are combined, with said plug having a plug axis extending in a direction of the linear array, said plug being accessible at a frontal end of said rigid cast enclosure; and means for fastening said rigid cast enclosure on the support, said means being provided in said rigid cast enclosure;

said plurality of transducer arrangements being fastened to the support such that said linear array of each said transducer arrangement extends in the axial direction of said support.

20. An underwater antenna as defined in claim 19 wherein: each of said plurality of transducer arrangements has a respective blind bore formed in an end surface of said rigid cast enclosure at a respective said frontal end; said plug of each of said plurality of transducer arrangements extends into the respective said blind bore for receiving a respective matching plug cooperating with said plug; said plurality of transducer arrangements are fastened to said support such that end surfaces and said blind bores of adjacent ones of said transducer arrangements face in opposite directions; and said matching plugs associated with said blind bores facing in one of said opposite directions are all connected to a first connector mounted on said support and said matching plugs associated with said blind bores facing in the other of said opposite directions are all connected to a second connector mounted on said support.

* * * * *